US006378717B1

(12) United States Patent
Reutter

(10) Patent No.: US 6,378,717 B1
(45) **Date of Patent: *Apr. 30, 2002**

(54) REMOVABLE CLOSURE CAP WITH TEMPERATURE DEPENDENT CONTROL ELEMENT

(76) Inventor: Heinrich Reutter, Theodor-Heuss-Str. 12, D-71336 Waiblingen-Hohenacker (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/737,801

(22) PCT Filed: May 31, 1995

(86) PCT No.: PCT/EP95/02074

§ 371 Date: Apr. 1, 1997

§ 102(e) Date: Apr. 1, 1997

(87) PCT Pub. No.: WO95/32904

PCT Pub. Date: Dec. 7, 1995

(30) Foreign Application Priority Data

Jun. 1, 1994 (DE) ..... 44 19 096
Jun. 25, 1994 (DE) ..... 44 22 292

(51) Int. Cl.[7] ..... B65D 55/00

(52) U.S. Cl. ..... 220/201; 220/DIG. 32; 220/89.1; 220/316; 165/72

(58) Field of Search ..... 220/201, DIG. 32, 220/DIG. 33, 203.1, 203.26, 203.28, 203.01, 203.09, 316, 89.1, 86.2; 165/104.32, 278, 71, 72

(56) References Cited

U.S. PATENT DOCUMENTS 2,528,372 A 10/1950 Kellogg (List continued on next page.)

FOREIGN PATENT DOCUMENTS

| | | | | |
|---|---|---|---|---|
| DE | 2145441 | * | 3/1973 | ..... 220/203.01 X |
| FR | 1600373 | | 8/1970 | |
| GB | 2 210 863 A | | 6/1989 | |
| SU | 1641717 | * | 1/1991 | ..... 220/201 |
| WO | WO 92/05084 | | 4/1992 | |

*Primary Examiner*—Allan N. Shoap
(74) *Attorney, Agent, or Firm*—Jones, Tullar & Cooper, P.C.

(57) ABSTRACT

A closure cap which can screw onto the fixed neck of a cooling system expansion tank. The closure cap is provided with a screw cap and a threaded section in which a combination pressure-vacuum valve is mounted concentrically and in such a way that it can rotate in relation to the screw cap. The valve is provided with a sealing element which comes into tight contact with the fixed neck when the closure is screwed. To endure that the closure cap can be unscrewed only when the excess heat in the cooling system has been completely dissipated, it is proposed that the closure cap when screwed onto the fixed neck would be prevented from unscrewing means of a temperature-dependent control element.

10 Claims, 12 Drawing Sheets

U.S. PATENT DOCUMENTS 3,338,445 A 8/1967 Miller
3,700,166 A * 10/1972 Fouts
3,820,593 A * 6/1974 Pabst ..... 165/104.32 X
4,196,822 A * 4/1980 Avrea ..... 220/DIG. 32 X
4,271,976 A * 6/1981 Detwiler
4,453,668 A * 6/1984 Abel
4,457,327 A * 7/1984 Pepper ..... 220/201 X
4,483,287 A * 11/1984 Monigold et al.
4,498,599 A * 2/1985 Avrea
4,540,103 A * 9/1985 Kasugai et al. .. 220/DIG. 32 X
4,865,249 A * 9/1989 Sugano et al.
4,872,584 A * 10/1989 Sakai ..... 220/201
4,927,049 A * 5/1990 Giordano ..... 200/DIG. 32 X
5,042,677 A * 8/1991 Chen et al. ..... 220/201
5,174,463 A * 12/1992 Scharrer ..... 220/DIG. 32 X
5,197,440 A * 3/1993 Georgs et al. ..... 165/104.32 X
5,248,052 A * 9/1993 Mellinger et al. ..... 220/DIG. 32 X
5,357,909 A * 10/1994 Attinger et al. ..... 165/104.32 X
5,603,425 A * 2/1997 Breeden ..... 220/203.26 X
5,649,639 A * 7/1997 Dolvet et al. ..... 220/203.28 X
5,941,407 A * 8/1999 De'Longhi ..... 220/DIG. 32 X
6,073,791 A * 6/2000 Reutter ..... 220/DIG. 32 X
6,178,930 B1 * 1/2001 Triberti ..... 220/DIG. 32 X

* cited by examiner 110
22
31
32
17
121
18
26
27
25
115
149
24
23
28
148
137
138
114
16
120
11
153
13

210'
214'
22
17
221'
18
26
27
25
215'
28
23
24
220'
255'
16
259'
11
238'
266'
265'
237'
13
267'

REMOVABLE CLOSURE CAP WITH TEMPERATURE DEPENDENT CONTROL ELEMENT

FIELD OF THE INVENTION

The present invention relates to a closure cap to be fixed in place, preferably by screwing, plugging and rotating, on, for example, a fixed connector of a motor vehicle radiator, a compensator reservoir for cooling or heating systems, or the like.

BACKGROUND OF THE INVENTION

Closure caps of this type are used, for example, in motor vehicle cooling systems, either directly as a radiator cap or as the closure of the compensator reservoir. The closure cap can either be screwed on by means of a screw thread, or it can be plugged on and turned by means of a bayonet element. In connection with motor vehicles there is a problem with respect to the closure caps, due to as a rule the pressure is high because the high temperature in the cooling system. Even if at the time of stopping the engine the temperature in the cooling system is not excessive, it is possible that after turning the engine off a temperature and therefore a pressure increase can take place because of a certain after-heating effect. If in such a case the closure cap is immediately removed, there is the acute danger of scalding for the respective user. This danger exists in particular also with screwable caps, since in the course of unscrewing the closure cap the user is not urged to slow the unscrewing process in the last phase, or better yet to interrupt it and mainly to wait until a pressure equalization with the ambient air has taken place. Although a ventilated connection between the cooling system and the exterior is opened in the course of unscrewing the closure cap, this cannot take place as rapidly as the user can possibly unscrew the closure cap. The same applies correspondingly when using a cap provided with a bayonet closure.

SUMMARY OF THE INVENTION

It is therefore an object of the present invention to provide a closure cap of the type mentioned at the outset, which cannot be removed if the cooling system is still at an excess temperature, but only after the excess temperature has been completely reduced, and which nevertheless is constructed in a space saving manner.

This object is intended to be attained by means of a closure cap having an actuating element, a temperature-dependent control element in the form of a memory spring, a control bolt, and a return spring with a collar. The memory spring is disposed off-centered and seated in an axial recess in the cap or in the actuating element. The control bolt directly causes coupling or uncoupling of the cap and the actuating element, or the memory spring is centrally disposed and a horizontal connecting leg of a U-shaped coupling element rests above the actuating element on the end of the axial control bolt facing the cap. The memory spring is acted upon by a return spring, whose other end is supported on the interior surface of the cap so that lateral vertical connecting legs project from above in the direction toward the actuating element, and at normal temperatures engage axial recesses in the actuating element for achieving a connection which is fixed against relative rotation.

A closure cap is provided which cannot be removed if a critically high temperature still prevails in the cooling system (or in the heating system). By means of this it is prevented in every case that injuries because of high temperature and the overpressure resulting therefrom in the fixed connector can occur during opening of the closure cap. The temperature-dependent control element is here housed in a space-saving manner with the coupling element.

In accordance with an exemplary embodiment it is possible to provide the temperature-dependent element between the cap and the valve or the cap and the connector, so that locking, fixed against relative rotation, of the cap with respect to the fixed connector takes place.

However, a preferred embodiment of the present invention is realized by means of an actuating element maintained rotatable with respect to the cap and that at normal temperature a coupling, fixed against relative rotation can be achieved by means of the temperature-dependent control element. In this case it has been achieved that the cap turns idly with respect to the actuating element, so that removal of the closure cap from the fixed connector is impossible, even when using force.

BRIEF DESCRIPTION OF THE DRAWINGS

Further details of the present invention can be taken from the following description, in which the present invention will be described in detail and explained by means of the exemplary embodiment represented in the drawings. Shown are.

DESCRIPTION OF THE PREFERRED EMBODIMENTS

Figures 1A, 1B:
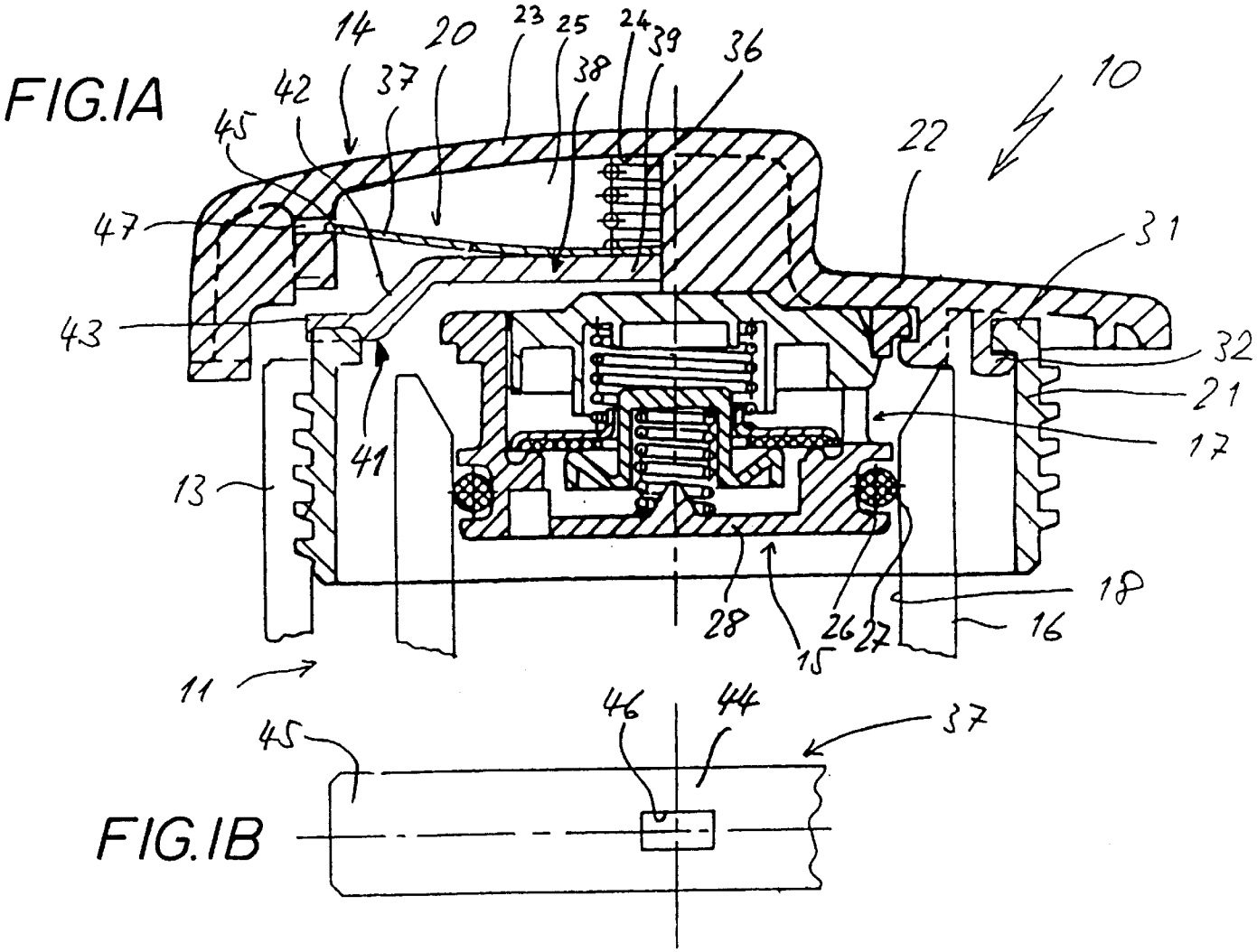
FIG. 1A, which is a longitudinal section, prepared at different levels on the left and right of the center line, through a closure cap screwed on a fixed connector of a reservoir and having a temperature-dependent unscrewing safety element in accordance with a first exemplary embodiment of the present invention, FIG. 1B which is a top view in a partially broken representation, of a temperature-dependent control element employed as the unscrewing safety element in the closure cap in FIG. 1A, FIGS. 2A and 2B, which show representations corresponding to FIGS. 1A and 1B of the closure cap and associated temperature-dependent control element, but in accordance with a second exemplary embodiment of the present invention,, FIGS. 3A and 3B, which show representations corresponding to FIGS. 1A and 1B of the closure cap and associated temperature-dependent control element, but in accordance with a third exemplary embodiment of the present invention, FIGS. 4 and 5, which are a representation respectively corresponding to FIG., 1A, but in accordance with a fourth and fifth exemplary embodiment of the present invention, FIGS. 6 and 7, which are a representation respectively corresponding to FIG. 1A, but in accordance with a sixth and seventh exemplary embodiment of the present invention, FIGS. 8 and 9, which are a representation respectively corresponding to FIG. 1A, but in accordance with an eighth and ninth exemplary embodiment of the present invention, FIGS. 10 and 11, which are a representation respectively corresponding to FIG. 1A, but in accordance with a tenth and eleventh exemplary embodiment of the present invention, and FIG. 12, which is a representation corresponding to FIG. 6, but in accordance with a twelfth exemplary embodiment of the present invention.

The closure cap 10, 10', 10", 110, 110', 210, 210', 310, 310' 410 or 410', represented in the drawings in twelve exemplary embodiments, which is screwed on the fixed connector 11 of a compensator reservoir, not further represented, of a motor vehicle cooling system, has a screw cap 14, 14', 141", 114, 114', 214, 214', 314, 314', 414, 414', an external thread element 21, 21', 21", 121, 121', 221, 221', 321, 321', 421, 421' and a valve 15, 15', 15", 115, 115', 215, 215', 315, 315', 415, 415'. In these exemplary embodiments the connector 11 of the compensator reservoir has two concentric elements, namely an interior threaded element 13 on the outside and not shown in FIGS. 2A and 3A, which receives the external thread element 21, 21', 21", 121, 121', 221, 221', 321, 321', 421, 421' of the closure cap 10, 10', 10", 110, 110', 210, 210', 310, 310', 410 or 410' in a screwed manner, and a neck 16 located on the inside, which is engaged by the valve 15, 15', 15", 115, 115', 215, 215', 315, 315', 415, 415' of the closure cap 10, 10', 10", 110, 110', 210, 210', 310, 310', 410 or 410'. It is understood that it is also possible to provide the closure cap 10, 10', 10", 110, 110', 210, 210', 310, 310', 410 or 410' with an inner thread and/or to embody it in such a way that it can be directly screwed on the fixed connector of a motor vehicle radiator. In connection with the closure cap 10, 10', 10", 110, 110', 210, 210', 310, 310', 410 or 410' in accordance with the present invention it is essential that it is provided with a temperature-dependent unscrewing safety element 20, 20', 20", 120, 120', 220, 220', 320, 320', 420, 420', which assures that the closure cap 10, 10', 10", 110, 110', 210, 210', 310, 310', 410 or 410' can only be removed or unscrewed from the respective fixed connector after the compensator reservoir or the motor vehicle radiator or the like has been lowered to the normal or ambient temperature.

In all exemplary embodiments the screw cap 14, 14', 14", 114, 114', 214, 214', 314, 314', 414, 414' of the closure cap 10, 10', 10", 110, 110', 210, 210', 310, 310', 410 or 410' is provided with a cover plate 22, over which a gripping bar 23, for example, extends diagonally. The screw cap 14, 14', 14", 114, 114', 214, 214', 314, 314', 414, 414' is hollow, while in the area of the gripping bar 23 the hollow chamber 24, cylindrical per se, is extended by means of rectangular-shaped depressions 25.

Figure 8:
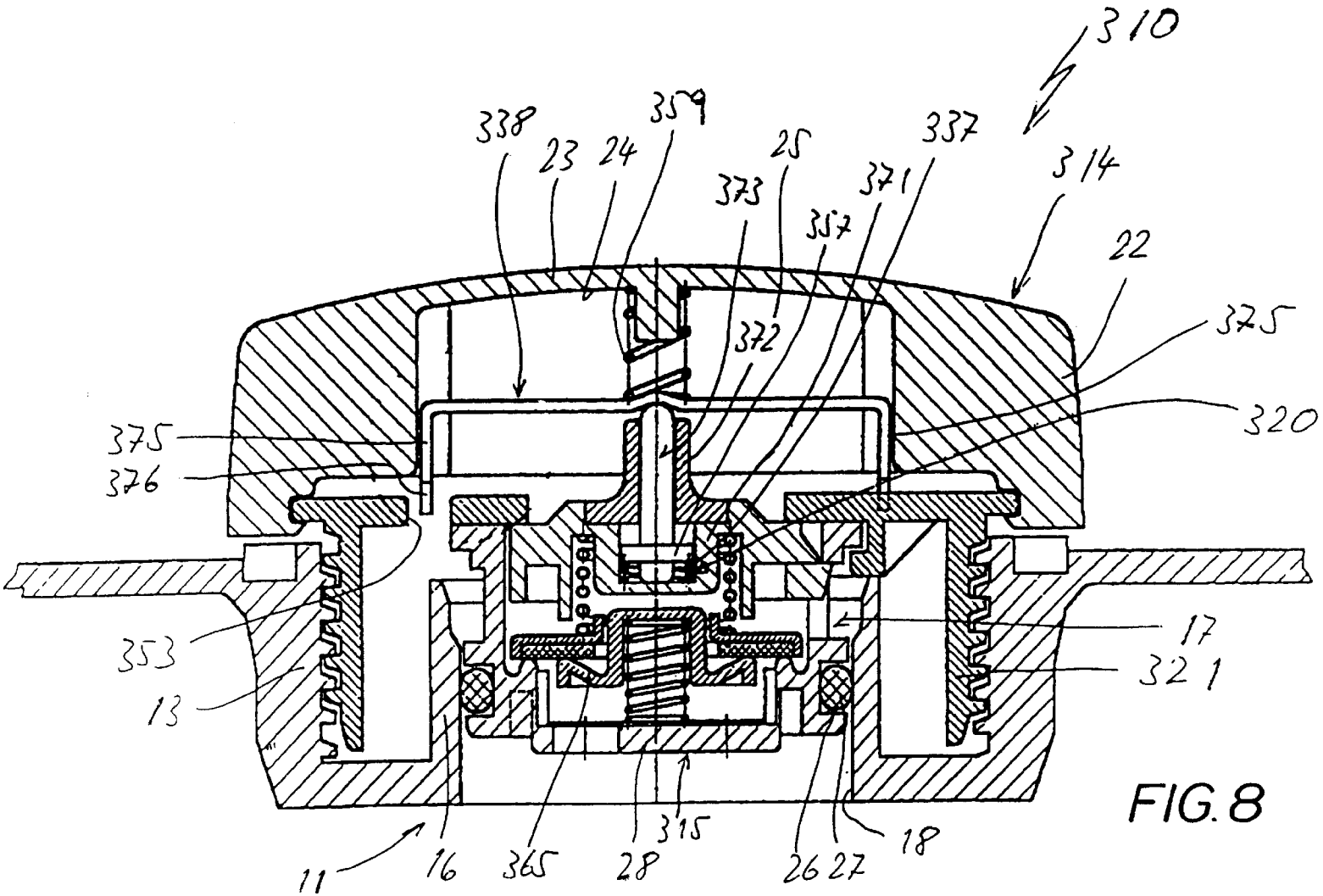
Figure 9:
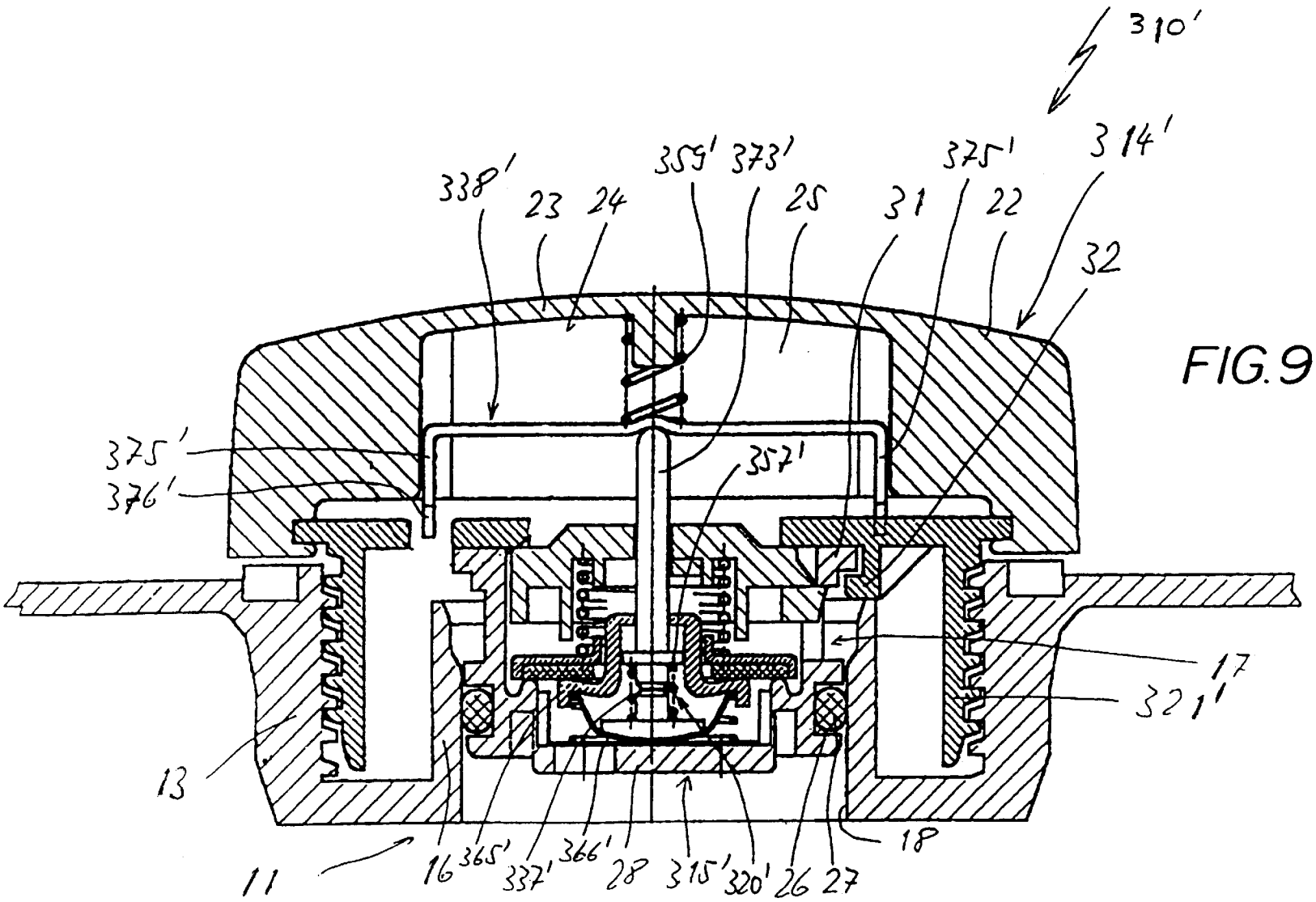
Figure 10:
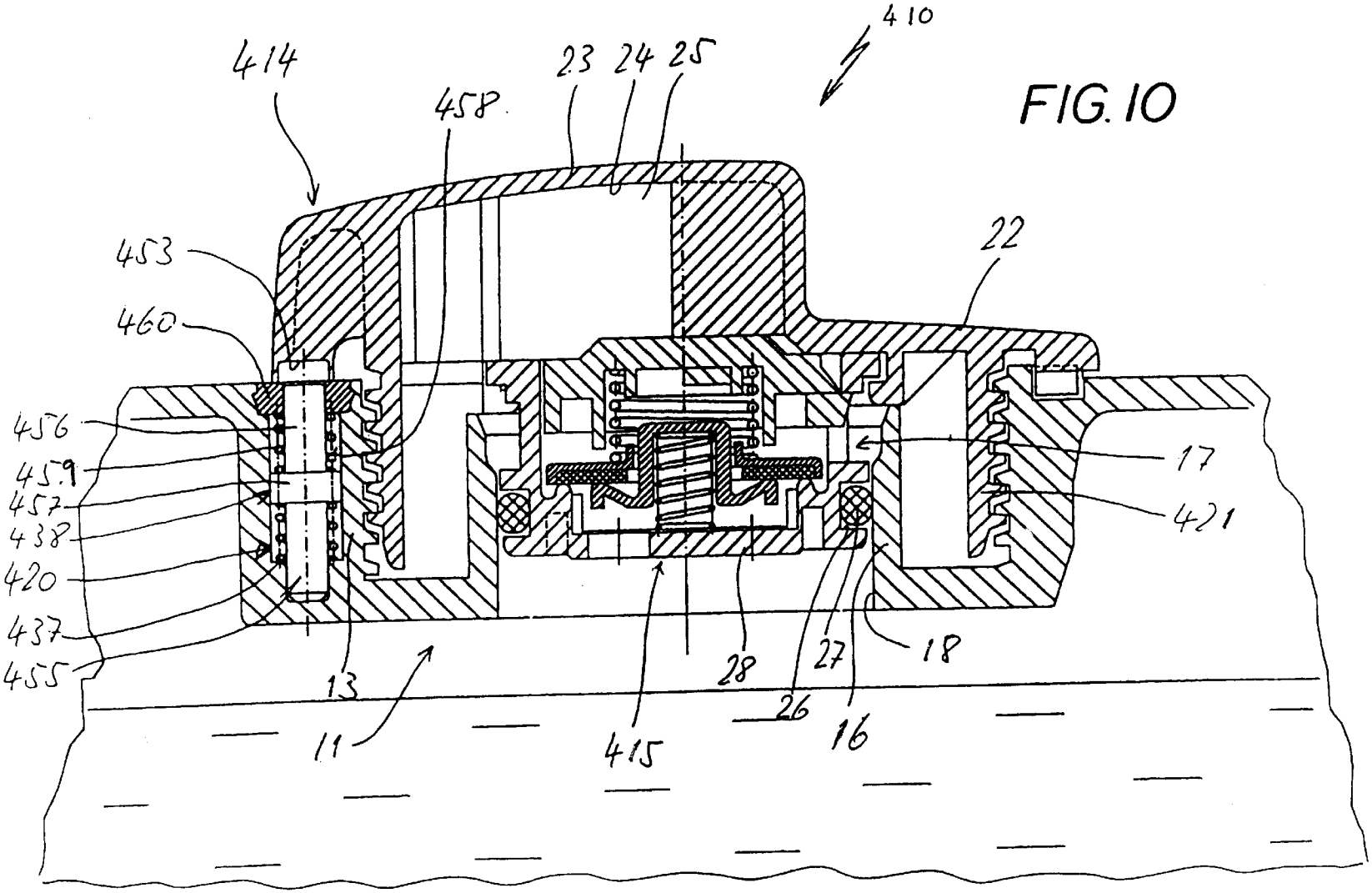
Figure 11:
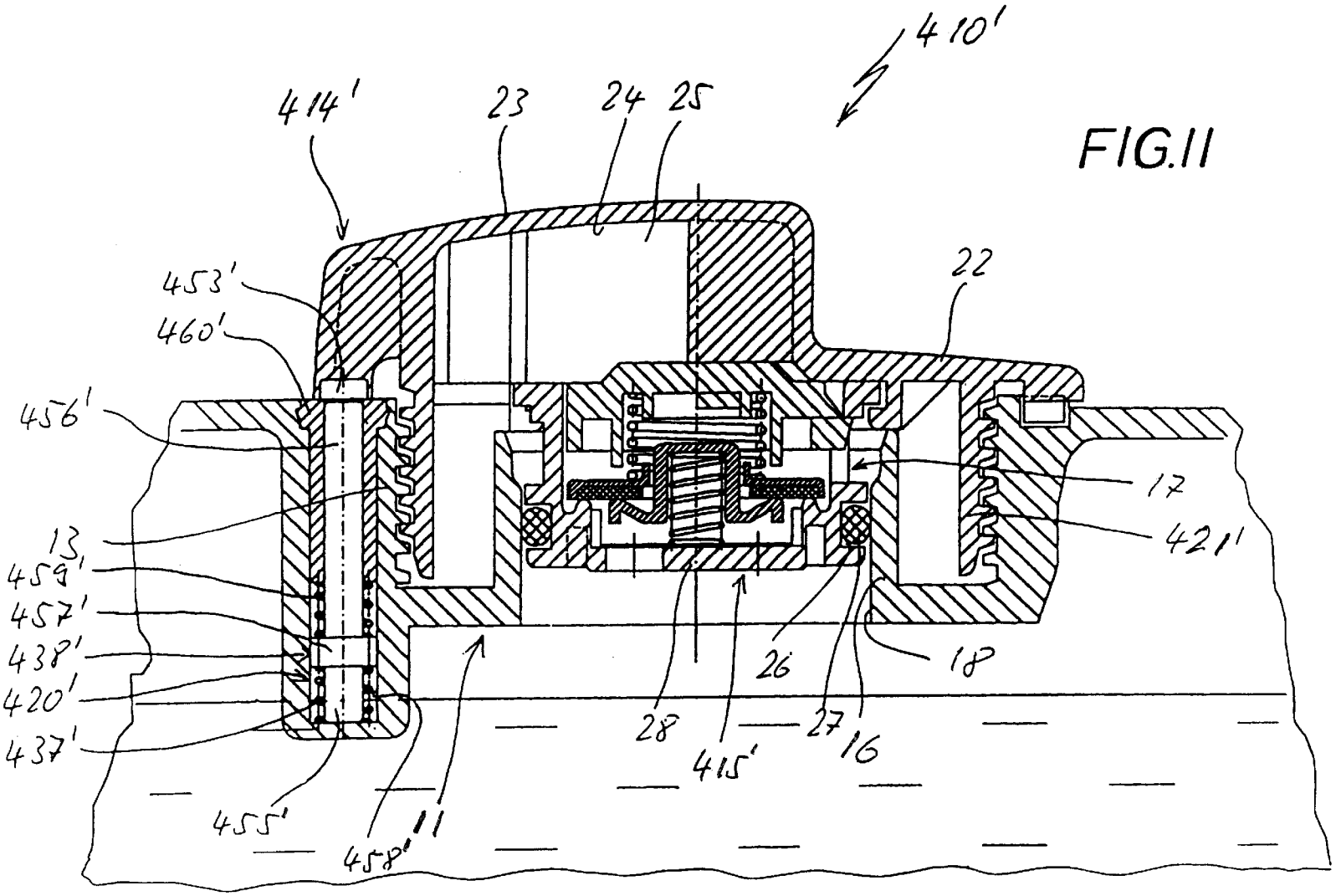

In the exemplary embodiments in accordance with FIGS. 1 to 9, the screw cap 14, 14', 14", 114, 114', 214, 214', 314, 314', 414, 414' and the external thread element or connector 21, 21', 21", 121, 121', 221, 221', 321, 321', 421, 421' of the closure cap 10, 10', 10", 110, 110', 210, 210', 310, 310', 410 or 410' are separate components and are connected with each other in such a way that, although they cannot be moved axially, they are movable in the circumferential direction, and with the exemplary embodiments in accordance with FIGS. 10 and 11 they are respectively combined into a one-piece component. In the first case the connector threaded on the exterior is provided with an inward projecting annular collar 31, which engages a holding ring 32 which is L-shaped in cross section and is discontinuous in the area of the depressions 25 and formed in one piece on the underside of the cover plate 22. By means of this, the connector threaded on the exterior is maintained suspended on the underside of the screw cap.

Inside the screw cap 14, 14', 14", 114, 114', 214, 214', 314, 314', 414, 414' or the external thread element or connector 21, 21', 21", 121, 121', 221, 221', 321, 321', 421, 421' and concentrically with the latter, a valve housing 17 of the valve on the screw cap 14, 14', 14", 114, 114', 214, 214', 314, 314', 414, 414' is held rotatable in relation to the latter and essentially immovable in the axial direction. The relative rotatability between the valve housing 17 and the screw cap 14, 14', 14", 114, 114', 214, 214', 314, 314', 414, 414' is achieved in a manner similar to the relative rotatability between the screw cap and the connector threaded on the exterior. In a manner which will not be described in detail because it is known per se, the valve is embodied as a combined overpressure/underpressure valve which, in the state where the closure cap 10, 10', 10", 110, 110', 210, 210', 310, 310', 410 or 410' is screwed on the fixed connector 11, opens in case of the appearance of too great an excess pressure or underpressure and thus protects the cooling system. At its front end 28, the valve housing 17 is provided with an annular groove 26, into which an O-ring 27 has been placed, which sealingly rests against the smooth inner surface 18 of the neck 16 of the compensator reservoir when the closure cap 10, 10', 10", 110, 110', 210, 210', 310, 310', 410 or 410' is entirely screwed on.

In the first exemplary embodiment in FIGS. 1A and 1B, a compression spring 36 is provided axially centered inside the hollow chamber 24 of the screw cap 14, one end of which is supported on the raised part of the cover plate 22 in the area of the gripping bar 23. A temperature-dependent control element in the form of an elongated narrow bimetal plate or strip 37 and an extended control plate 38, which can be moved opposite the action of the compression spring 36 in the axial direction of the closure cap 10, face the other end of the compression spring 36. The bimetal plate 37 and the control plate 38 extend over a considerable portion of the length of the gripping bar 23. In its center area the control plate 38 is embodied flat, and on its other outer end areas 41 (only one of which is visible in FIG. 1A), it is provided with a crimping 42, whose free end 43 can engage the annular collar 31 for a connection fixed against relative rotation. The bimetal strip 37 is disposed on the top of the control plate 38 facing the compression spring 36. The center area 44 of the bimetal plate 37 lies between the other end of the compression spring 36 and the center area 39 of the control plate 38. The bimetal strip 37 can be fixedly connected with the control plate 38 or rest only loosely on it. As can be taken from FIG. 1B, the center area 44 of the bimetal strip 37 which, the same as the control plate 38, extends crosswise over the gripping bar 23 or the two depressions 25, is provided with a rectangular-shaped recess 46 for a connection, fixed against relative rotation, with the screw cap 14. The same applies in a similar way to the control plate 38 in a manner not shown. In a state of normal temperature (ambient temperature), the bimetal strip 37 is shaped in such a way that its outer free ends 45 are located in a plane above the center areas 39 or 44 of the control plate 38 or the bimetal strip 37. The outer free ends 45 of the bimetal strip 37, which therefore are concave, are held longitudinally movable in slits 47 of the screw cap 14.

If the closure cap 10 in the state, where it is screwed on the connector 11 of the compensator reservoir 12, as partially shown in FIG. 1A, is exposed to a preselected critical excess temperature in the connector 11 of the compensator reservoir, this excess temperature is transmitted to the temperature-dependent control element, i.e. the bimetal strip 37, so that under the influence of this excess temperature it is deformed from its concave shape into a flat straight shape. This means that the center area 44 of the bimetal plate 37 moves against the force of the compression spring 36 and in this way relieves the control plate 38 of the pressure of the compression spring 36. If the bimetal strip 37 and the control plate 38 are connected with each other in the center areas 39, 44, the control plate 38 is lifted by the bimetal strip 37. This means that the free ends 43 of the crimping 42 of the control plate 38 come free of the upper or toothed annular surfaces of the annular collar 31. In other words, the external thread connector 21 and the screw cap 14 can be rotated with respect to each other, i.e. the external thread connector 21 is no longer moved along with the screw cap 14 when the latter turns; the screw cap 14 turns idly.

If the bimetal strip 37 and the control plate 38 are not connected with each other in the axial direction, the control plate 38 is only relieved of pressure when the bimetal strip 37 is deformed when an excess temperature occurs. In this case it is practical to provide the connection between the free ends 43 of the crimping 42 of the control plate 38 and the upper surface of the annular collar 31 of the external thread connector 21 by means of a toothed ratchet connection, so that upon pressure relief of the control plate 38 and rotation of the screw cap 14 it can slidingly move with its outer free ends over the surface of the annular collar 31 which is provided with teeth.

Figures 2A, 2B:
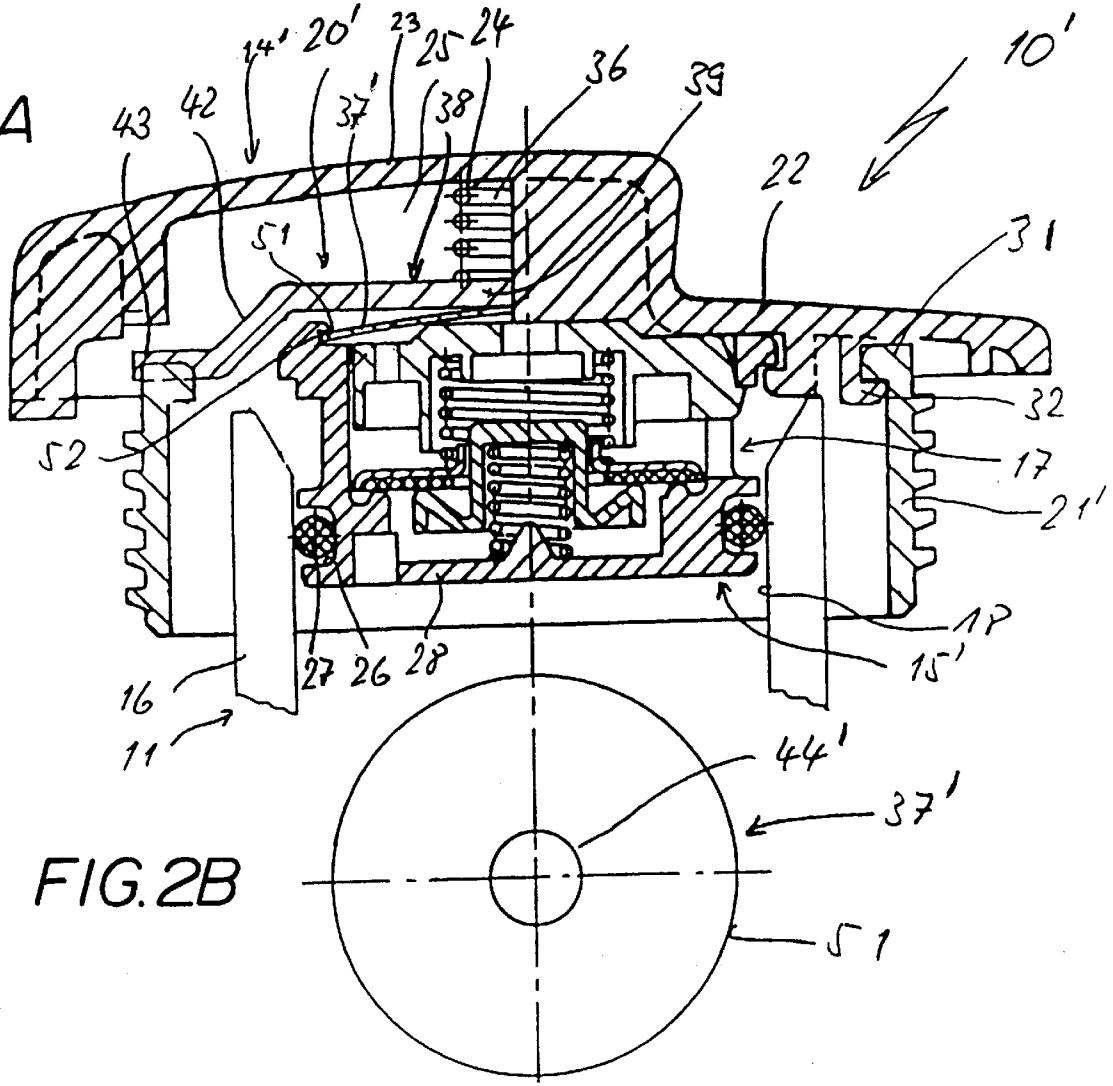

The second exemplary embodiment of the present invention represented in FIGS. 2A and 2B, differs from the exemplary embodiment represented in FIGS. 1A and 1B in the following manner: Although the compression spring 36 and the control plate 38 have the same shape as in the first exemplary embodiment, the compression spring 36 is supported with its other end directly on the control plate 38. A circular bimetal plate 37' (see FIG. 2B) is disposed on the underside of the control plate 38. The central area 44' of the bimetal plate 37' rests against the underside of the control plate 38, while the outer rim 51 of the bimetal plate 37' is held in an annular groove 52 on the top of the valve housing 17.

At ambient temperature, the bimetal plate 37' is shaped and arranged in such a way, that under the pressure of the compression spring 36 the outer ends 41 of the control plate 38 can engage the top of the annular collar 31 of the external thread connector 21' in a manner fixed against relative rotation. If an excess temperature occurs, the bimetal plate 37' is deformed in such a way that its central area 44' moves in an axial direction against the force of the compression spring 36 and in this way lifts the control plate 38, so that its outer ends 41 come free of the annular collar 31' of the external thread connector 21'. In this way the external thread connector 21' cannot turn along with the rotation of the screw cap 14'.

Figure 3A:
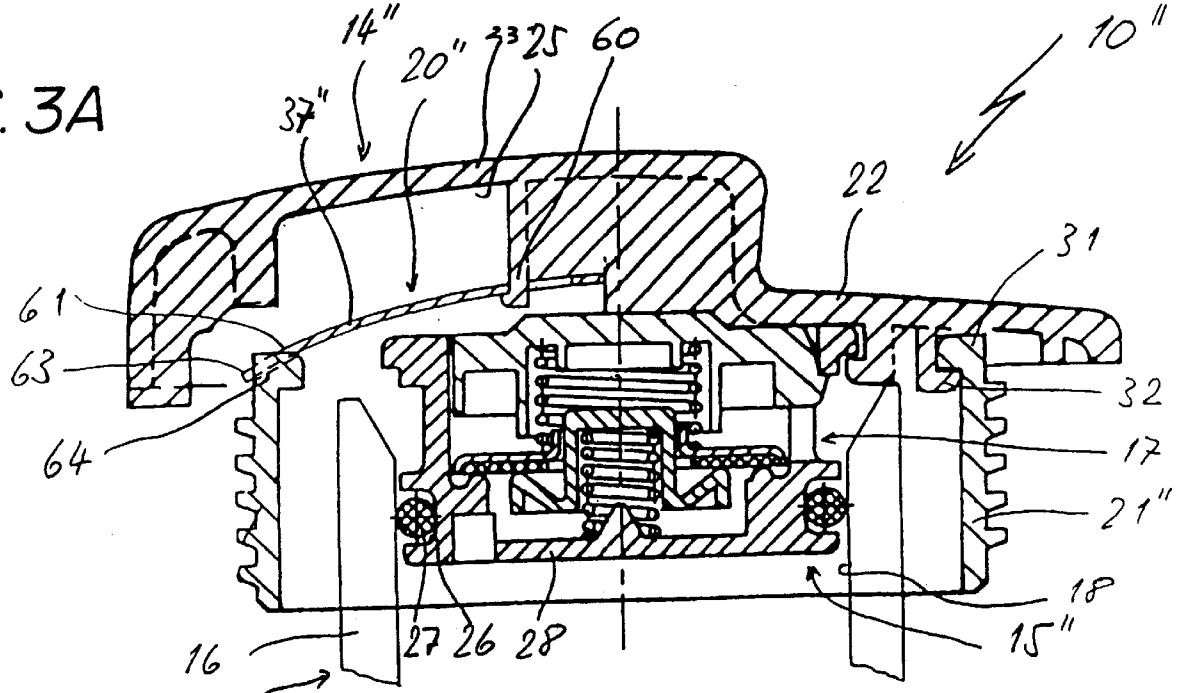
Figure 3B:
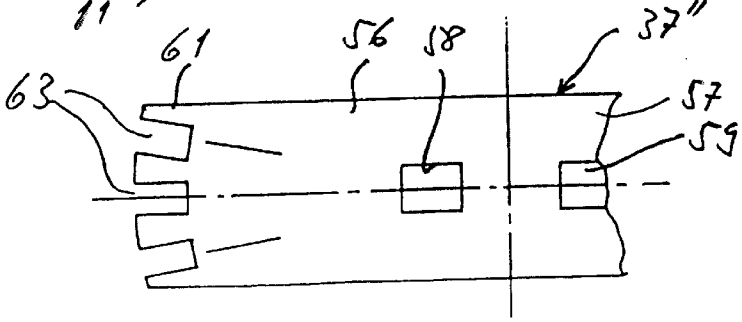

No separate control element is provided in the third exemplary embodiment represented in FIGS. 3A and 3B, instead, the function of the control element 38 of the two previously described exemplary embodiments is taken over by the free ends 61 of a temperature-dependent control element, which is in the form of a bimetal plate 37". The elongated bimetal plate 37" has two arms 56 and 57, which are connected in one piece with each other and which are provided with recesses 58, 59 near their connected area, by means of which they are held, fixed against relative rotation, in a respective shoulder 60 on the inside of the screw cap 14". The free ends 61 of the bimetal plate 56, 57 are provided with teeth 63, which can engage corresponding teeth 64 on the top of the annular collar 31 of the external thread connector 21".

As can be taken from FIG. 3A, at normal temperature the two bimetal plate arms 56, 57 are formed in such a way, that they arch downward in relation to the central area, thus the bimetal plate 37" can be embodied convex. If an excess temperature occurs in the connector 11 or the compensator reservoir, the bimetal plate 37" is deformed into an approximately straight level, which means that the free ends 61 move pivotingly or deformingly upward. By means of this the teeth 63, 64 of the bimetal plate arms 56, 57 and the annular collar 31" come free of each other. Therefore twisting of the external thread connector 21" is no longer possible when the screw cap 14" is turned; the screw cap 14" turns idly.

In connection with the last mentioned third exemplary embodiment of the present invention it is also possible to make the bimetal plate 37" in the form of a cross in the case where the screw cap 14" is provided with a cross-shaped four-armed gripping bar in place of an elongated two-armed one.

Figure 4:
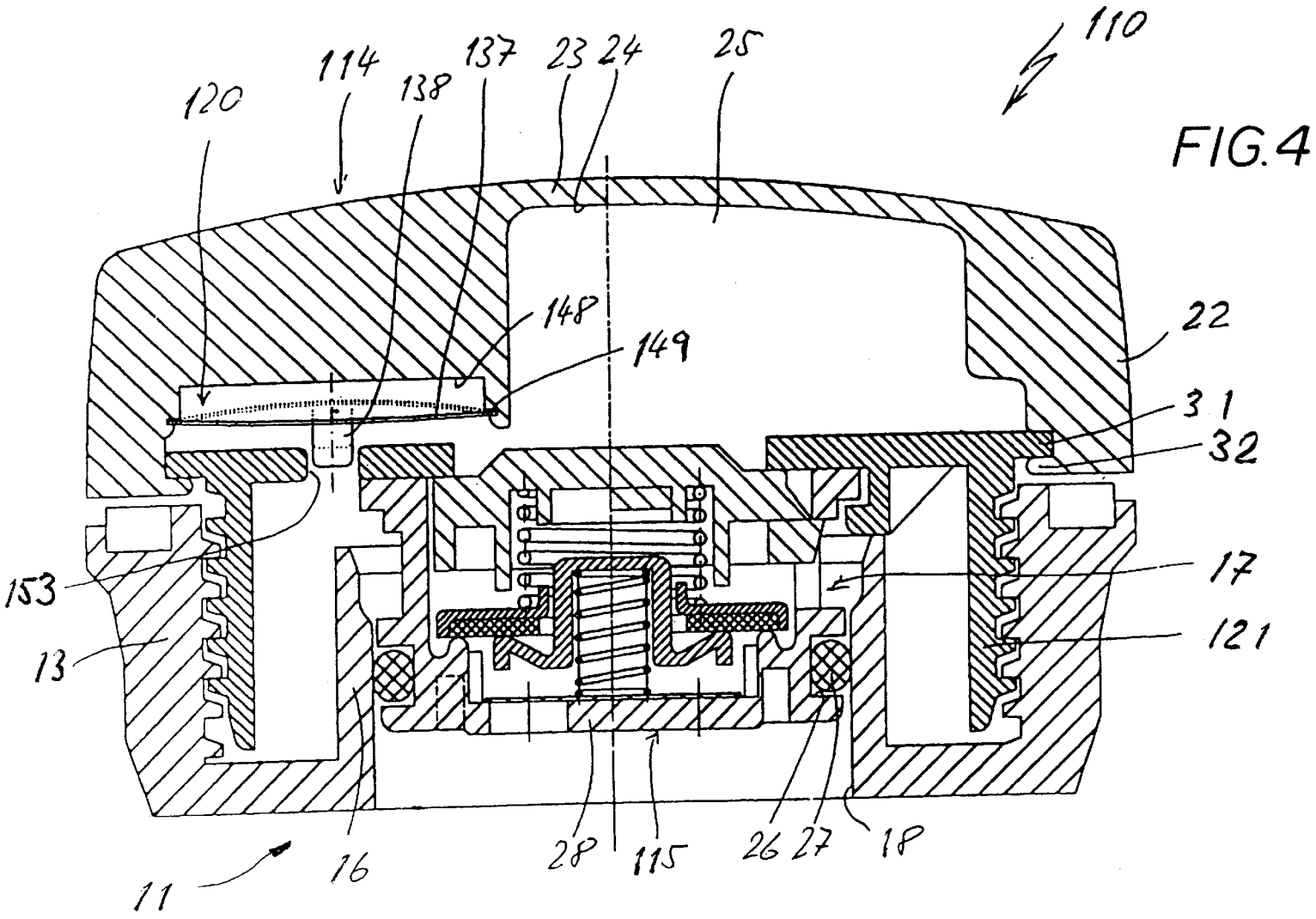

In the fourth exemplary embodiment of the present invention represented in FIG. 4, the temperature-dependent unscrewing safety element 120 is formed by one or several temperature-dependent control elements in the form of one or several bimetal strips or plates 137, which are disposed evenly distributed on the circumference of the screw cap 114. The bimetal strip or plate 137 is clamped with both ends or its edge in a recess 148 on the inside of the screw cap 114. The bimetal strip 137 or the bimetal plate is equipped in the center between the clamping receptacle(s) 149 with a control element embodied as a control cam 138, which is oriented toward the external thread element 121. The external thread element 121 has a number of axial bores 153 corresponding to the number of the bimetal strips or plates 137 or the number of control cams 138, into which one or more of the control cams 138 can enter, so that an interlocking connection between the screw cap 114 and the external thread element 121 is generated. At normal temperature in the reservoir connector 11, the bimetal strip or plate 137 is in the position represented in FIG. 4, in which a revolving connection between the screw cap 114 and the external thread element 121 has been made. In case of an excessively high temperature in the connector 11, the bimetal strip or plate 137 is deflected into the position shown by dashed lines, in which the control cam 138 comes free of the axial bore 153 and therefore releases the interlocking connection. Now the screw cap 114 turns idly with respect to the external thread element 121.

Figure 5:
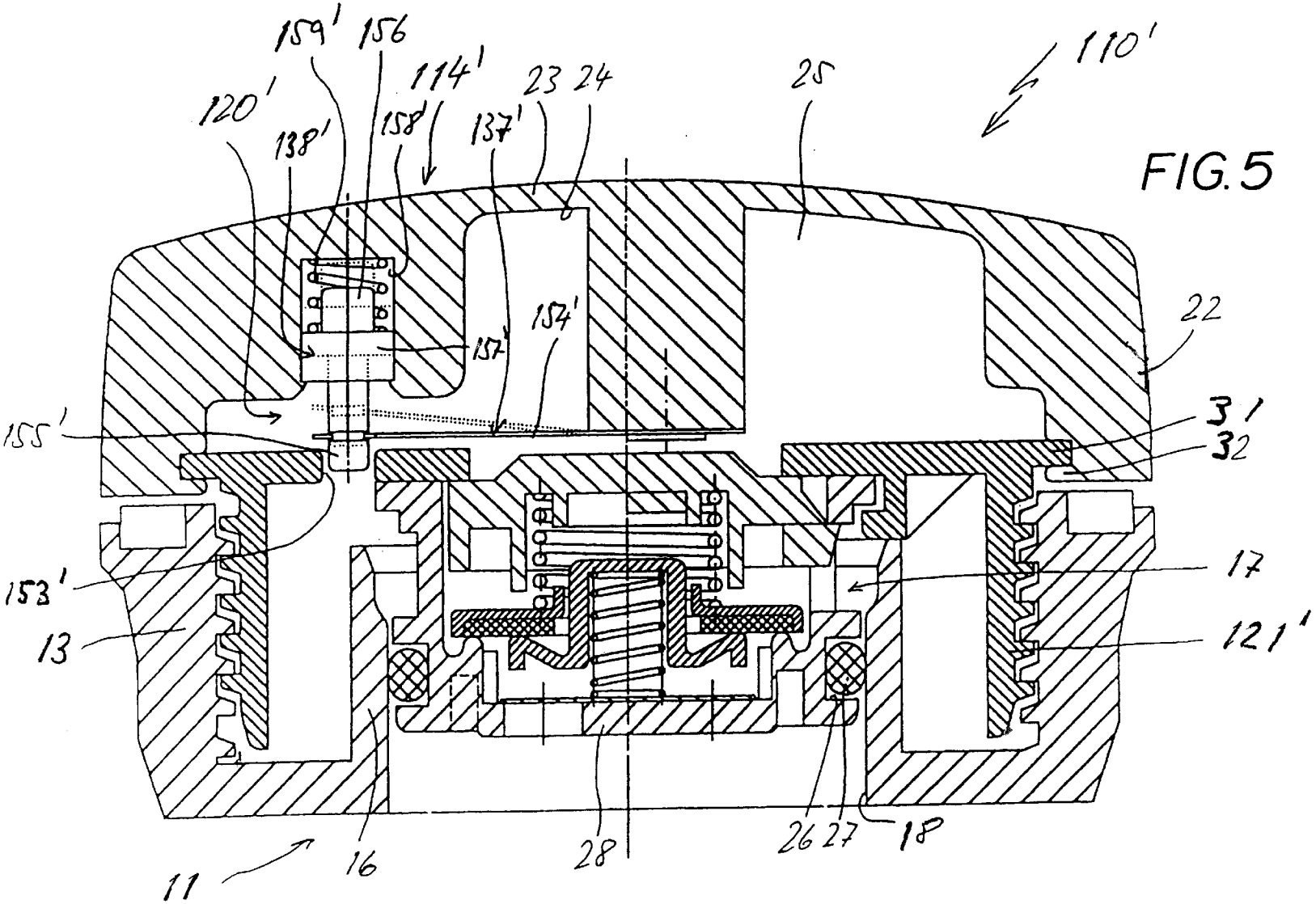

In the fifth exemplary embodiment of the present invention represented in FIG. 5, the closure cap 110' has a temperature-dependent unscrewing safety element 120' with a temperature-dependent control element in the form of a bimetal element 137' on the inside of the screw cap 114'. The bimetal element 137' is fastened approximately centered on the underside of the screw cap 114' and has one or several arms 154' evenly distributed over the circumference, whose free end cooperates with an axially extending control cam 138'.

With its front end 155' facing the external thread element 121', the control cam 138' enters an axial bore 153' of the screw cap 114', while its rear end 156', which engages an axial recess 158' of the screw cap 114', is supported on a return spring 159'. At normal temperature there is an interlocking connection, fixed against relative rotation, between the screw cap 114' and the external thread element 121' because the front end 155' of the control cam 138' engages the axial bore 153' under the force of the return spring 159'. With an appropriately high temperature, the bimetal arm 154 of the bimetal element 137' is deflected against the force of the return spring 159', so that the front end 155' of the control cam 138' comes free of the bore 153'. The screw cap 114' turns idly with respect to the external thread element 121'.

In the exemplary embodiments of the present invention represented in FIGS. 6 to 11, the temperature-dependent control element of the temperature-dependent unscrewing safety element 220, 220', 320, 320', 420 or 420' of the closure cap 210, 210', 310, 310', 410 or 410' is constituted by a memory spring 237, 237', 337, 337', 437 or 437'.

Figure 6:
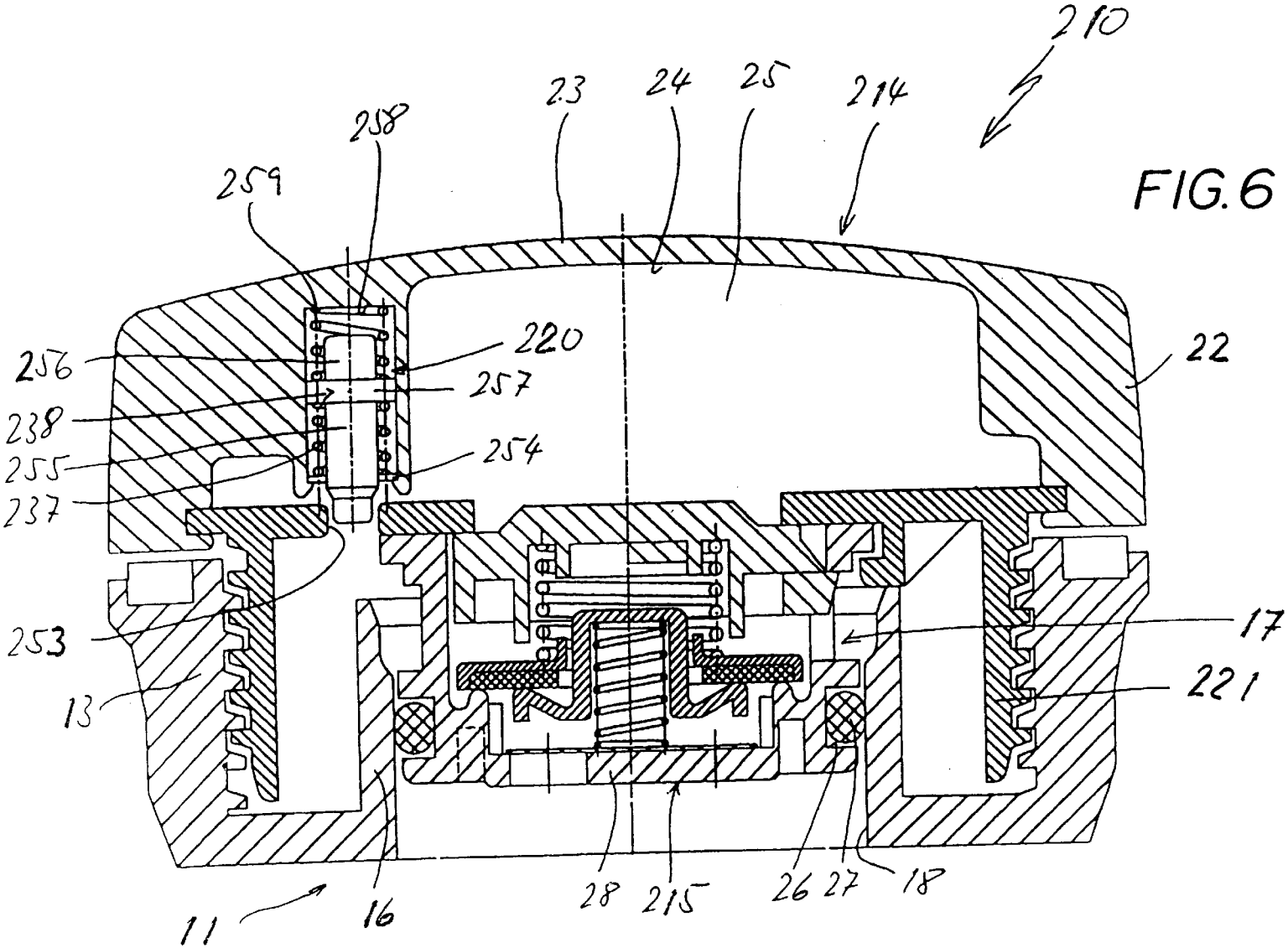
Figure 12:
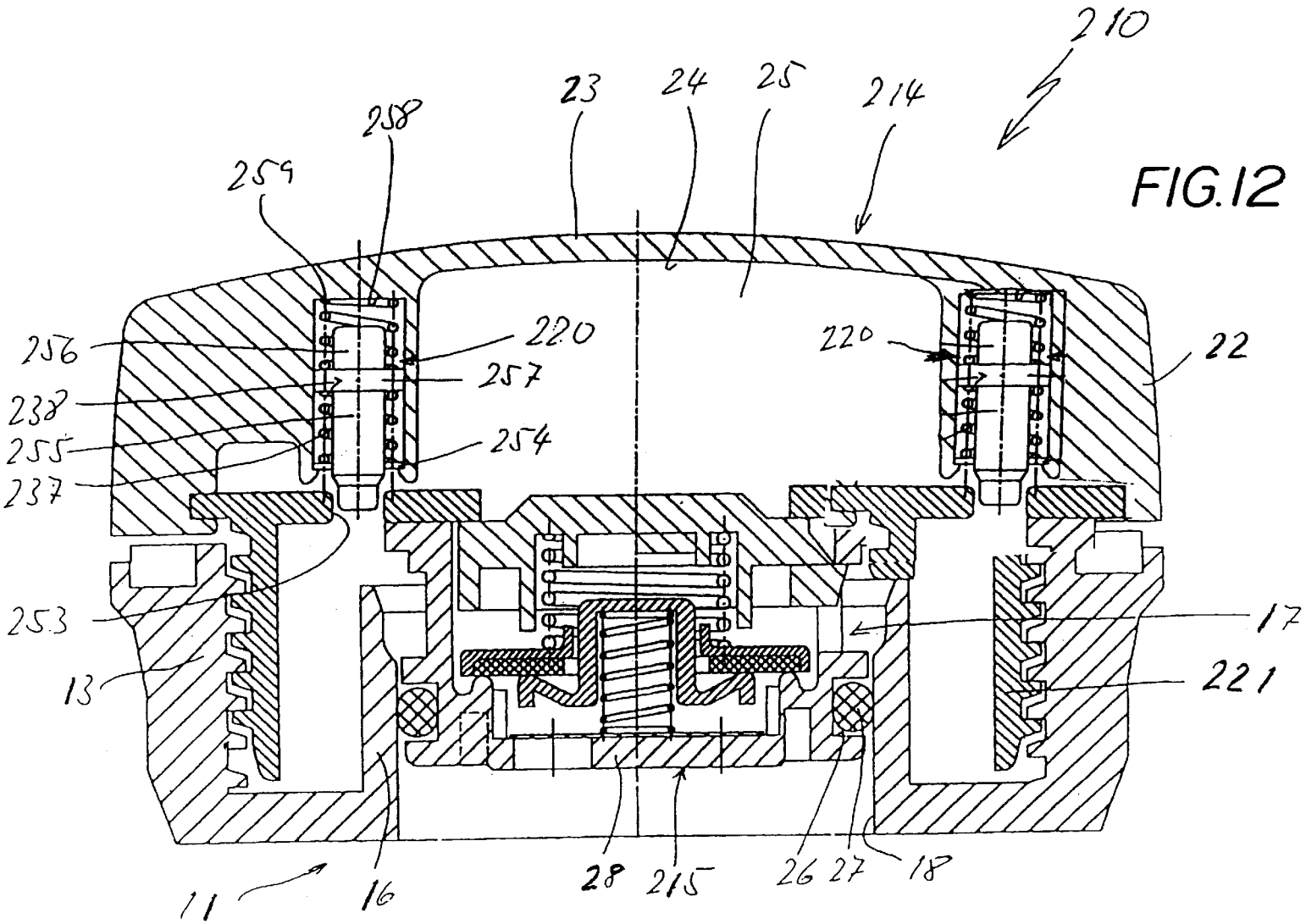

In the sixth exemplary embodiment of the present invention represented in FIG. 6, a control bolt 238 is disposed in an axial recess 258 accessible from the interior of the screw cap 214, wherein a return spring 259 is arranged around its back end 256, and the memory spring 237 is arranged around its front end 255. The return spring 259 is supported between the bottom of the axial recess 258 and a collar 257 while the memory spring 237 is supported between the collar 257 and its front abutment 254 Under normal temperature the front end 255 of the control bolt 238 is pressed by the force of the return spring 259 into an axial bore 253 in the external thread element 221, so that an interlocking connection, which is fixed against relative rotation, is formed between the screw cap 214 and the external thread element 221. At an appropriately high predetermined temperature the memory spring 237 expands and pushes the control bolt 238 against the force of the return spring 259 into the axial recess 258 in the screw cap 214, so that the front end 255 of the control bolt 238 comes free of the axial bore 253 in the external thread element 221. It is understood that such a temperature-dependent control element in the form of a memory spring 237 can also be provided at several locations which are evenly distributed over the circumference, in place of one location on the circumference of the closure cap 210. See FIG. 12.

Figure 7:
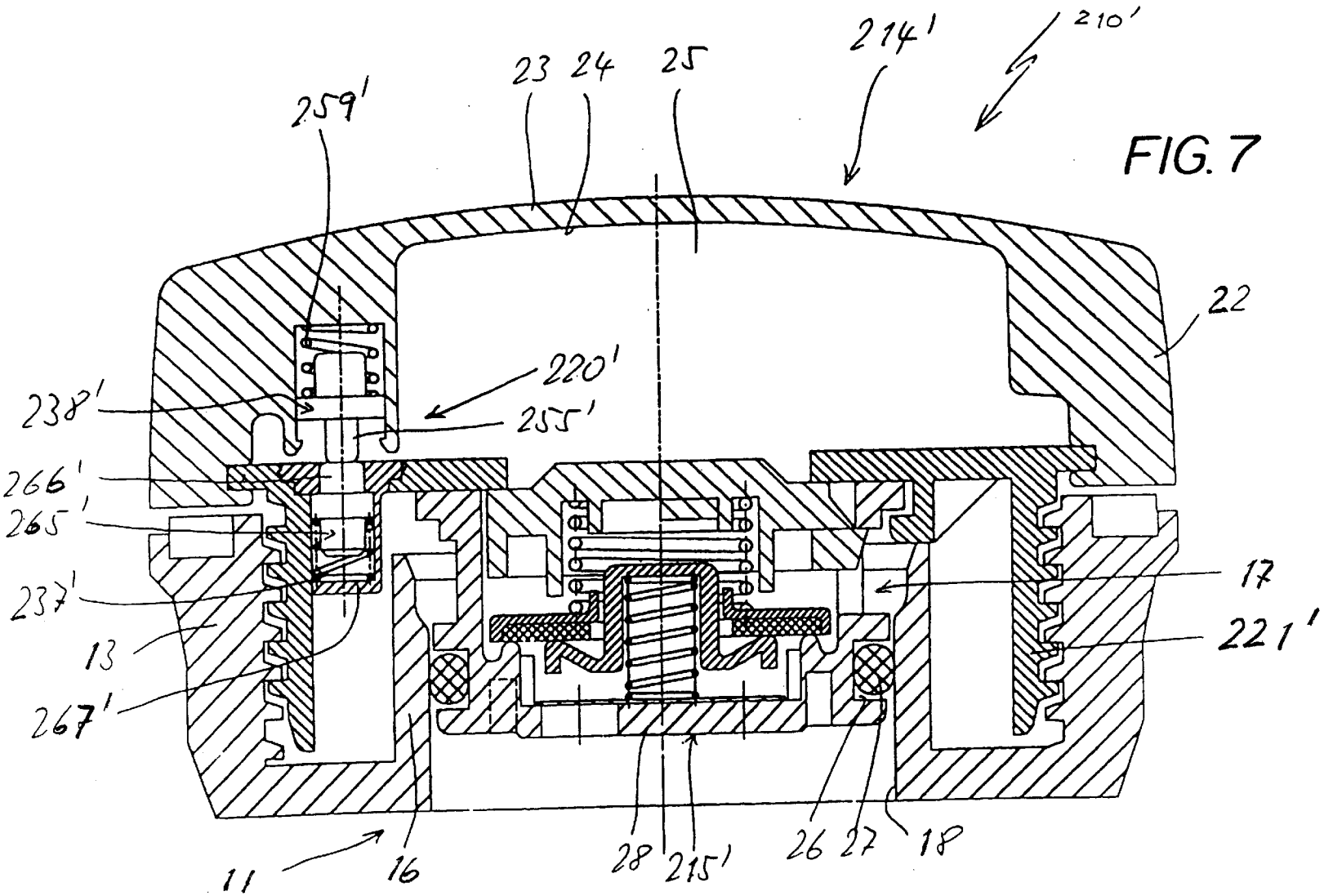

In the seventh exemplary embodiment in accordance with the present invention represented in FIG. 7, the return spring 259' and the memory spring 237' are housed at different locations, namely in the screw cap 214' and the external thread element 221'. While the return spring 259' acts on a control bolt or cam 238', the memory spring 237' pushes on a counter-bolt 265', whose front end 266' in turn pushes against the front end 255' of the control bolt 238'. Depending on the temperature prevailing in the connector 11, either the front end 266', of the counter-bolt 265' or the front end 225' of the control bolt 238' are located in the axial bore 253' of the external thread element 221'. In the case represented in FIG. 7, free-wheeling between the screw cap 214' and the external thread element 221' is provided at the predetermined unacceptably high temperature, since with its force caused by the high temperature the memory spring 237' pushes the control bolt 238' back against the force of the return spring 259'. The memory spring 237' with the counter-bolt 265' is maintained in a receiver housing 267' disposed at the edge of the external thread element 221'. It is understood that here, too, instead of one temperature-dependent control element at a defined location of the circumference of the closure cap 210, several such temperature-dependent control elements, distributed over the circumference, can be provided.

In the eight exemplary embodiment in accordance with the present invention of a closure cap 310 represented in FIG. 8, the temperature-dependent control element embodied as the memory spring 337 is disposed axially centered inside the valve 315. A collar 357 of a connecting bolt 373 is axially movable in a cup-shaped element 371 of the valve 315 disposed above an interior valve seal 365, wherein the connecting bolt 373 is acted upon by the memory spring 337 between its collar 357 and the bottom of the cup-shaped element 371 and projects through a lead-through 372 covering the cup-shaped element. The horizontal connecting leg of a control element 338 bent in a U-shape rests on the portion of the axial bolt 373 penetrating through the lead-through 372 and is acted upon by a return spring 359, which on its other end is supported on the interior surface 24 of the screw cap 314. With their finger-like ends 376, lateral legs 375 of the control element 338, projecting as far as the external thread element 321, are located opposite an axial bore 353 in the external thread element 321, and at normal temperature in the connector 11 enter it for a connection, fixed against relative rotation, between the screw cap 314 and the external thread element 321. At the predetermined high temperature value the memory spring 337 expands against the force of the return spring 359, so that the axial bolt 373 pushes the control element 338 against the force of the return spring 359 upward in the direction toward the inner surface 24 of the screw cap 314, and in the course of this the finger-like ends 376 of the control element 338 come free of the axial bores 353. Now the screw cap 314 turns idly with respect to the external thread element 321. It is understood that the control element 338 can also have more than two lateral legs 375, i.e. that it can be star- or cross-shaped, for example.

In the ninth exemplary embodiment in accordance with the present invention of a closure cap 310' represented in FIG. 9, the memory spring 337' is on the other side, viewed from the direction of the screw cap 314', of the inner valve seal 365'. To this end the axial connecting bolt 373' penetrates the seal 365', so that the collar 357' of the bolt 373' is maintained axially movable inside the cup-shaped seal 365'. A shell-shaped sealing cuff 366', on which the shell 366' is indirectly supported, is provided facing away from the lead-through of the bolt 373' through the seal 365'. The manner of operation of this ninth exemplary embodiment corresponds to that of the eighth exemplary embodiment.

In the tenth exemplary embodiment of the present invention of a closure cap 410 represented in FIG. 10, the temperature-dependent control element 437 of the temperature-dependent unscrewing safety element 420 has been placed into the connector 11 of the respective reservoir, by means of which it is achieved that at a predetermined high temperature value a blockage, i.e. a connection fixed against relative rotation, between the screw cap 414 and the connector 11 of the reservoir is achieved. Here, too, the temperature-dependent control element is formed by a memory spring 437 which, as in the exemplary embodiment of FIG. 6, together with a return spring 459 surrounds an inner or outer end 455, 456 of a control bolt 438. The lower or inner spring in FIG. 10 is the memory spring 437, one end of which is supported at the bottom of an axial recess 458 in the connector 11 and on the other end at a collar 457 of the control bolt 438. On the other hand, one end of the reset or return spring 459 is supported on the collar 457 and the other end on an annular inset 460 of the axial recess 458. The screw cap 414 has an axial blind bore or recess 453, accessible from its interior, into which the tip of the front end 455 of the control bolt 438 can enter for a connection, fixed against relative rotation, and thus a blockage of the screw cap 414. This occurs at high temperatures, in which the memory spring 437 is expanded against the force of the return spring 459 and in the process pushes the control bolt 438 into the axial blind bore 453. It is also possible here to provide several control elements distributed over the circumference of the connector 11 in place of one temperature-dependent control element.

The eleventh exemplary embodiment of the present invention of a closure cap 410 represented in FIG. 11 essentially corresponds to the exemplary embodiment in FIG. 10, with the exception, that the memory spring 437' and also the return spring 459' have been displaced in the connector 11 further down or inward in the direction toward the water level of the respective reservoir. This only requires an extension of the control bolt 438'.

Thus, by means of the exemplary embodiments of the closure cap 10, 10', 10", 110, 110', 210, 210', 310, 310', 410 or 410', it is either achieved that the connector with the external thread can no longer be moved by the screw cap when a predetermined excessively high temperature occurs in the connector 11 or the compensator reservoir, since because of the deformation of the temperature-dependent control element, the control plate or the temperature-dependent control element itself are released from the connection, fixed against relative rotation, with the external thread connector of the closure cap, or achieves a lock, fixed against relative rotation, between the screw cap and the reservoir connector. At normal temperature the temperature-dependent control element returns into its initial position again, so that in the first case the connection, fixed against relative rotation, between the screw cap and the external thread connector is again made, and in the second case the lock is released.

In another exemplary embodiment of the present invention, not represented in the drawings, the temperature-dependent control element is not provided between the screw cap and the external thread connector, but between the screw cap and the valve housing. In this case the external thread connector is of one piece with the screw cap, and the valve housing is disposed inside the compensator reservoir connector 11, fixed against relative rotation, but movable in the axial direction. In this case the function is as follows: At ambient temperature the valve housing is rotatable relative to the screw cap or the external thread connector, wherein during unscrewing of the closure cap the valve is taken along in the axial direction. However, if overpressure occurs while the closure cap is screwed on, the temperature-dependent control element cause a connection, fixed against relative rotation, or locking between the screw cap and the valve housing, which itself is held fixed against relative rotation in the connector 11. The screw cap can therefore not be turned.

Although defined types of bimetal or memory springs have been represented and described above, it is understood that other shapes, such as flat, helical, straight forms or the like, are also possible for either the bimetal spring or also the memory spring.

The steps in accordance with the present invention can also be realized in connection with a closure cap which is connected in the manner of a bayonet closure with a connector. In this case the element described as a thread element is embodied as a plug-and-turn element, while the screw cap is embodied as a plug-and-turn cap.

It is understood that a closure cap of this type can be used not only with components of radiators or cooling systems, but also with components of heating systems.

What is claimed is:

1. A closure cap to be fitted in place by one of screwing, plugging and rotating, on a fixed connector comprising one of a motor vehicle radiator and a compensator reservoir for cooling or heating systems, the fixed connector having a neck portion defining an interior surface, the closure cap comprising:

a cap defining a center axis of said closure cap;

an actuating element rotatable with respect to said cap;

a valve mounted within said actuating element and arranged concentrically with said cap and said actuating element and rotatably moveable relative thereto, said valve including a sealing element for sealing contact with the interior surface of the neck portion on the closure cap as attached to the fixed connector portion; and a temperature-dependent control element for securing said cap against removal by rotation from the fixed connector at high temperature and permitting rotation of said cap from said fixed connector at normal temperature, said temperature-dependent control element having a control bolt movable substantially axially relative to the center axis of said cap, a collar operatively associated with said control bolt, and a memory spring having ends which engages said collar at one end, with said ends opposed, wherein said temperature-dependent control element is located in one of said cap and said cap and actuating element.

2. The closure cap as defined in claim 1, wherein said temperature-dependent control element is located in said cap, said actuating element includes an axial recess which receives said control bolt at normal temperatures.

3. The closure cap as defined in claim 2, wherein said temperature-dependent control element is located off-center relative to the center axis of said cap.

4. The closure cap as defined in claim 1, wherein said temperature-dependent control element further has a U-shaped coupling element which engages said control bolt and said return spring, said U-shaped coupling element having vertically connected legs which project in the direction of said valve, said U-shaped coupling element and said return springy located in said cap.

5. The closure cap as defined in claim 4, wherein said temperature-dependent control element is located coaxial with the center axis of said cap.

6. The closure cap as defined in claim 5, wherein said actuating element includes a recess for receiving a respective one of said vertically connected legs.

7. The closure cap as defined in claim 1, wherein said temperature-dependent control element is located in the fixed connector, said cap including a recess which receives said control bolt at normal temperatures.

8. The closure cap as defined in claim 7, wherein said temperature-dependent control element is located off-center relative to the center axis of said cap.

9. A closure cap to be fitted in place by one of screwing, plugging and rotating, on a fixed connector comprising one of a motor vehicle radiator and a compensator reservoir for cooling or heating systems, the fixed connector having a neck portion defining an interior surface, the closure cap comprising:

a cap defining a center axis of said closure cap;

an actuating element rotatable with respect to said cap;

a valve mounted within said actuating element and arranged concentrically with said cap and said actuating element and rotatably moveable relative thereto, said valve including a sealing element for sealing contact with the interior surface of the neck portion on the closure cap as attached to the fixed connector portion; and a plurality of temperature-dependent control elements for securing said cap against removal by rotation from the fixed connector at high temperature and permitting rotation of said cap from said fixed connector at normal temperature, said temperature-dependent control elements each having a control bolt movable substantially axially relative to the center axis of said cap, a collar operatively associated with said control bolt, and a memory spring having ends which engages said collar at one end, with said ends opposed, wherein said temperature-dependent control elements are located in one of said cap and said cap and actuating element.

10. A closure cap to be fitted in place by one of screwing, plugging and rotating, on a fixed connector comprising one of a motor vehicle radiator and a compensator reservoir for cooling or heating systems, the fixed connector having a neck portion defining an interior surface, the closure cap comprising:

a cap defining a center axis of said closure cap;

an actuating element rotatable with respect to said cap;

a valve mounted within said actuating element and arranged concentrically with said cap and said actuating element and rotatably moveable relative thereto, said valve including a sealing element for sealing contact with the interior surface of the neck portion on the closure cap as attached to the fixed connector portion; and a plurality of temperature-dependent control elements for securing said cap against removal by rotation from the fixed connector at high temperature and permitting rotation of said cap from said fixed connector at normal temperature, said temperature-dependent control elements each having a control bolt movable substantially axially relative to the center axis of said cap, a collar operatively associated with said control bolt, and a memory spring having ends which engages said collar at one end, with said ends opposed, wherein:

said temperature-dependent control elements are located in one of said cap, and said cap and actuating element;

said cap including a recess which receives said control bolt at normal temperature; and said temperature-dependent control elements are located off-center relative to the center axis of said cap.

* * * * *